US005278583A

United States Patent [19]

Oda et al.

[11] Patent Number: 5,278,583

[45] Date of Patent: Jan. 11, 1994

[54] INK-JET RECORDING APPARATUS

[75] Inventors: Gen Oda, Ebina; Masayoshi Miura, Kawasaki; Koichi Saito, Yokohama; Shuko Kanematsu, Tokyo, all of Japan

[73] Assignee: Matsushita Electric Industrial Co., Ltd., Osaka, Japan

[21] Appl. No.: 790,981

[22] Filed: Nov. 13, 1991

[30] Foreign Application Priority Data

Nov. 28, 1990 [JP] Japan ..... 2-332403
Sep. 25, 1991 [JP] Japan ..... 3-245605

[51] Int. Cl.[5] ..... B41J 2/06; B41J 2/14

[52] U.S. Cl. ..... 346/140 R

[58] Field of Search ..... 346/140; B41J 2/06, B41J 2/14, 2/135

[56] References Cited

U.S. PATENT DOCUMENTS 4,333,086 6/1982 Ebi ..... 346/140 R
4,734,705 3/1988 Rezanka ..... 346/1.1

FOREIGN PATENT DOCUMENTS 0398031 11/1990 European Pat. Off. .
56-8270 1/1981 Japan .
57-120452 7/1982 Japan .
58-208062 12/1983 Japan .
59-142156 8/1984 Japan .
59-146860 8/1984 Japan .
62-271752 11/1987 Japan .
1296841 3/1987 U.S.S.R. ..... 346/140 R

*Primary Examiner*—Benjamin R. Fuller
*Assistant Examiner*—Alrick Bobb
*Attorney, Agent, or Firm*—Lowe, Price, LeBlanc & Becker

[57] ABSTRACT

An ink-jet recording apparatus comprising an ink-discharging opening coupled to an ink chamber for discharging ink therefrom toward a recording sheet. The ink-discharging opening is formed at a center and bottom of a concave portion formed in a thin plate made of an insulating material. A first electrode is provided on one surface of the thin plate and around the concave portion and a second electrode is provided on the other surface of the thin plate and at the vicinity of the ink-discharging opening, the first and second electrodes being electrically coupled to an ink-discharging control signal source. This arrangement can omit an air supply system to simplify the structure of the recording apparatus.

2 Claims, 6 Drawing Sheets

INK-JET RECORDING APPARATUS

BACKGROUND OF THE INVENTION

The present invention relates to an arrangement of an ink-jet recording apparatus (printer) for discharging ink from a microscopic opening to record a character or picture on a recording sheet.

As exemplified by the Japanese Patent provisional Publication No. 57-120452 or 59-146860, there are known ink-jet recording apparatus which is arranged to discharge ink from a microscopic opening with the aid of an air stream and an electrostatic force, the arrangement of such a prior art ink-jet recording apparatus will be described hereinafter in detail. However, there is a problem which arises with the conventional ink-jet recording apparatus in that the apparatus cost increases because of the requirement of an air supply system and a high accuracy is required for the assembling of an air discharge opening and an ink discharge opening.

In addition, in a conventional electrostatic suction type ink-jet recording system as exemplified by the Japanese Patent Provisional Publication No. 58-208062, since the cross-sectional area of the portion between the ink discharge opening and the electrode opening is arranged to be spatially wider than the areas of the openings thereof, an extreme disadvantage occurs in the case of arranging nozzles with a high density for formation of multi-nozzles. Further, in cases where fine dust, ink and the like are inserted into the spatial area, the state of the electric field varies so that the discharge state becomes unstable to lower the reliability. Moreover, in view of the stability of the recording characteristic, difficulty is encountered in positioning between the ink discharge opening and the electrode opening, insuring of the degree of parallelization and assembling.

SUMMARY OF THE INVENTION

It is therefore an object of the present invention to provide an ink-jet recording apparatus which is capable of decreasing the apparatus cost, arranging nozzles with a high density and simplifying the assembling concurrently with improving the reliability of the apparatus.

In accordance with the present invention, there is provided an ink-jet recording apparatus comprising: a concave portion formed in a thin plate made of an insulating material; a convex ink-discharging opening formed at a center and bottom portion of the concave portion; a first electrode provided on one surface of the thin plate and around the concave portion; a second electrode provided on the other surface of the thin plate and at the vicinity of the ink-discharging opening; a signal source coupled to the first and second electrodes; an ink chamber communicating with the ink-discharge opening; and an ink tank coupled through an ink supply passage to the ink chamber.

Further, according to this invention, there is provided an ink-jet recording apparatus comprising: a concave portion formed in a thin plate made of an insulating material, the concave portion having an opening diameter of $\phi 2$; a convex ink-discharging portion formed at a center and bottom portion of the concave portion, the convex ink-discharging portion having an opening of a diameter of $\phi 1$; a first electrode disposed at a peripheral portion of the concave portion; a second electrode disposed at the vicinity of the ink-discharging opening; a signal source coupled to the first and second electrodes; and an ink chamber coupled to the ink-discharging opening, wherein, when a height of the convex ink-discharging portion is taken to be $L_1$ and a distance from a top surface of the convex ink-discharging portion to the first electrode is taken as $L_2$, a following relation is satisfied:

$$2 \leqq \phi 2/\phi 1 \leqq 10,\ 1 \leqq L_2/\phi 1 \leqq 20, \text{ and } L_1/\phi 1 \geqq 0.2.$$

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
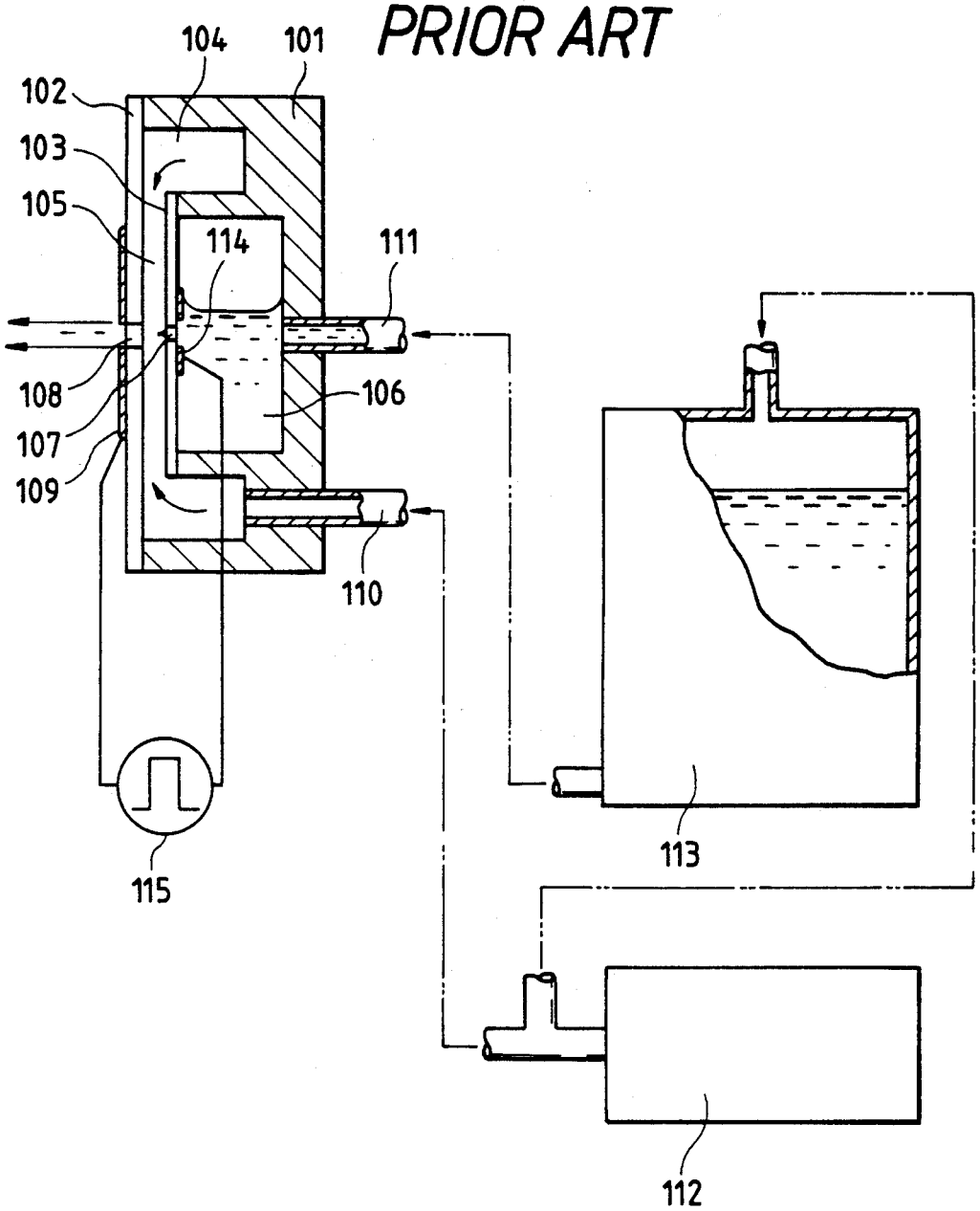
FIG. 1 PRIOR ART
FIG. 1 is a cross-sectional view showing an arrangement of a conventional ink-jet recording apparatus.

Prior to describing an embodiment of the present invention, a brief description of a prior art ink-jet recording apparatus will be made hereinbelow for a better understanding of this invention. In FIG. 1, an air nozzle plate 102 made of an insulating material is attached to a top portion of an outer wall of a body member 101 and an ink nozzle plate 103 made of an insulating material is attached to a top portion of an inner wall thereof. Between the outer wall and inner wall of the body member 101 there is formed an air chamber 104, and between the air nozzle plate 102 and the ink nozzle plate 103 there is formed an air passage 105 which communicates with the air chamber 104, and at the inside of the ink nozzle plate 103 there is formed an ink chamber 106. In the ink nozzle plate 103 there is formed an ink discharge opening 107 and in the air nozzle plate 102 there is formed an air discharge opening 108 which is disposed to be in opposed relation to the ink discharge opening 107. On the outer surface of the air nozzle plate 102 there is provided an electrode 109 which surrounds the air discharge opening 108. Further, an electrode 114 is provided at a peripheral portion of the ink discharge opening 107 and in the ink chamber 106. The air chamber 104 is arranged to communicate through an air supply passage 110 with an air supply source 112, and the ink chamber 106 is arranged to communicate through an ink supply passage 111 with an ink supply source 113.

The electrodes 109 and 114 are respectively coupled to a signal generating source 115.

Air is supplied from the air supply source 112 to the air chamber 104 so as to flows as an air layer toward the air passage 105 at a constant speed as it rapidly curves. Further, the air rapidly curves at the vicinity of the air discharge opening 108 and ink discharge opening 107 so as to flow out from the air discharge opening 108. On the other hand, ink is supplied from the ink supply source 113 to the ink chamber 106, and a constant pressure due to an air pressure supplied from the air supply source 112 is applied to the ink within the ink supply source 113 and ink chamber 106. Thus, at the non-recording time of the ink-jet recording apparatus, the air pressure due to the air flow at the vicinity of the ink discharge opening 107 substantially becomes equal to the ink pressure in the ink discharge opening 107 so that the meniscus of the ink to be generated at the ink discharge opening 107 is kept to be stationary. In response to generation of the electric potential difference between the electrodes 109 and 114, the meniscus of the ink generated at the ink discharge opening 107 due to the electrostatic force caused by the electric potential difference is stretched toward the air discharge opening 108. Since a rapidly inclined pressure variation occurs due to the air flow in the air passage 105 between the ink discharge opening 107 and the air discharge opening 108, the meniscus of the ink in the ink discharge opening 107 is rapidly accelerated after stretched by beyond a predetermined length so as to be discharged from the air discharge opening 108, thereby effecting the recording on a recording sheet.

The above-described ink-jet recording apparatus using an air flow and an electrostatic force has extreme advantages in the recording characteristic, that is, irrespective of using the electrostatic force, the drive is effected with a relatively low voltage (below 500 V), the responsibility is high (10 to 20 kHz) and the dot can be formed to be fine (20 to 30 $\mu m\phi$). However, it provides some problems other than the recording characteristic. In the first place, there is required the air supply system such as the air supply source 112 and the air supply passage 110. This surely increase the cost for the provision of the air supply system. Furthermore, there is a problem in reliability of the air supply system, that is, a problem in dust included in the supplied air and a problem in constancy of the air pressure. For countermeasure against this problem, a filter is provided or the air pressure is detected so as to make an electrical feedback for controlling. However, this additionally provides a problem that the apparatus is further complicated and the apparatus cost is further heightened.

In the second place, there is a problem in construction. In assembling, the air discharge opening 108 and the ink discharge opening 107 are required to be coaxially arranged each other with a high accuracy without being shifted in position. The diameters of both the openings 108 and 107 are extremely small to be below 100 $\mu m$ and hence the difference between the centers of both the openings 108 and 107 is required to be kept within several $\mu m$. In the case that the difference therebetween is too large, the flow in discharge curves to provide a problem in the recording characteristic. Further, it is required that the width of the air passage 105 is kept constant. This width is below 100 $\mu m$ and the degree of parallelization of the air passage 105 is required to be high so that the accuracy is kept to be below several $\mu m$. This width delicately affects the air pressure at the vicinity of the ink discharge opening 107. That is, as the width becomes wider, the air pressure at the vicinity of the ink discharge opening 107 increases to approach the pressure within the ink chamber 106 whereby difficulty is encountered to keep the configuration of the meniscus formed in the ink discharge opening 107 so as to be pressed out toward the air discharge opening 108, thereby reducing the ink discharge amount and lowering the responsibility. On the other hand, if the width becomes narrow, although the ink discharge amount and the responsibility respectively increase, the discharge becomes unstable. Accordingly, the width of the air passage is required to be adequately maintained in consideration of such balancing.

Figure 2:
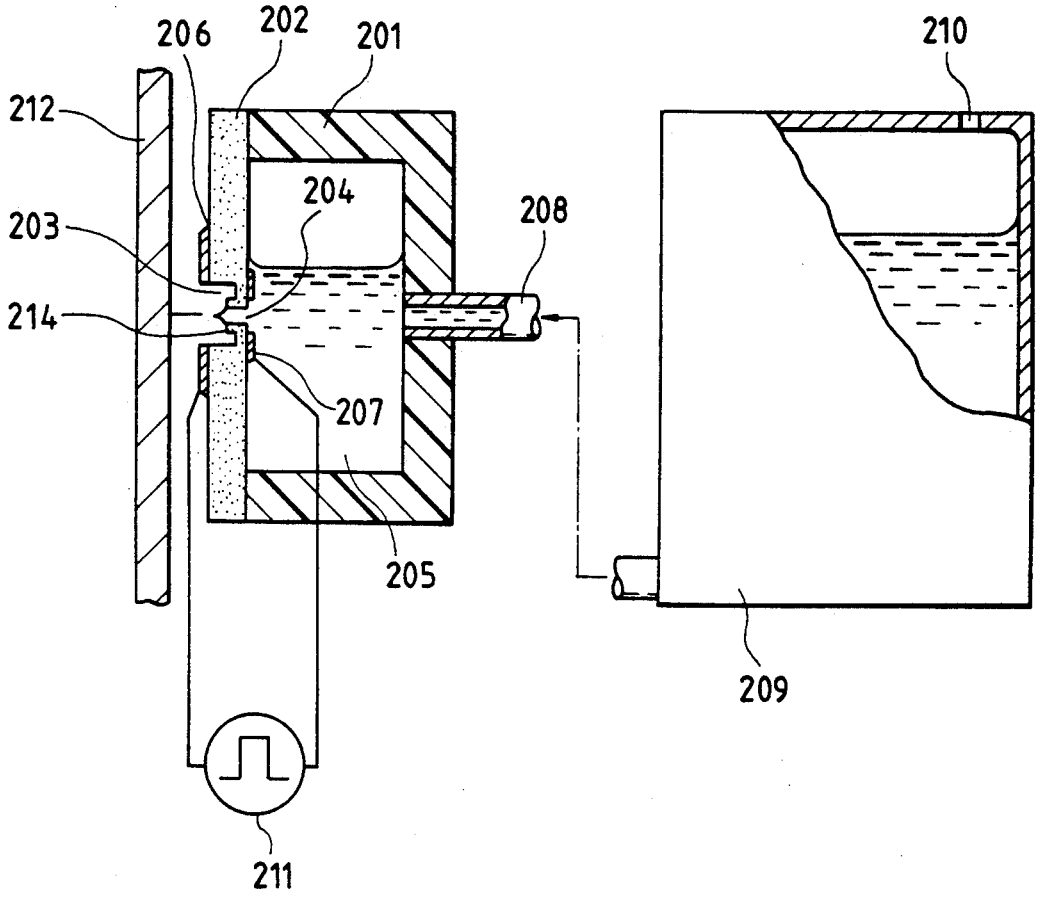
FIG. 2 is a cross-sectional view showing an arrangement of an ink-jet recording apparatus according to an embodiment of the present invention.

Referring now to FIG. 2, there is illustrated an arrangement of an ink-jet recording apparatus according to an embodiment of the present invention. In FIG. 2, designated at numeral 202 is a thin film made of an insulating material which has a cylindrical concave portion 203. At the center and bottom portion of the cylindrical concave portion 203 there is formed an ink discharge opening 204, a portion 214 around of the ink discharge opening 204 being circularly convexed to be protruded from the bottom surface of the cylindrical concave portion 203 so as to lengthen the axial length of the ink discharge opening 204. At the peripheral portion of the cylindrical concave portion 203 of the thin plate 202 and on the front surface of the thin plate 202 there is disposed a first electrode 206, and on the rear surface of the thin plate 202 and at the vicinity of the ink discharge opening 204 there is provided a second electrode 207, the first and second electrodes 206 and 207 being respectively coupled to a signal source 211. The ink discharge opening 204 is communicated with an ink chamber 205 formed by a body member 201 and further communicated through an ink supply passage 208 to an ink tank 209 having an air vent hole 210. At front of the thin plate 202 there is disposed a recording sheet 212, the position of the recording sheet 212 being relatively close thereto (below 2 mm). Here, the diameter of the ink discharge opening 204 is set to be several tens $\mu m$ and the diameter of the concave portion 203 is set to be two to ten times the diameter of the ink discharge opening 204. Further, the thin film 202 is required to be made of an insulating material.

In operation, in response to a voltage signal from the signal source 211 being applied between the first and second electrodes 206 and 207, because of the formation of the convex portion 214, an electric field is particularly concentrated easily to the surface of the meniscus formed in the ink discharge opening 204, and because of the cylindrical configuration of the concave portion 203, the ink is drawn from the ink discharge opening 204 by means of the electrostatic force so as to uniformly fly toward an external portion on or along the axis of the cylindrical concave portion 203. The flyed ink is attached to the recording sheet 212 to thereby effect the recording. Here, in the case that the recording sheet 212 is positioned to be extremely away from the head section, the flyed ink is drawn by the electrode 206 and attached thereto. Thus, as described above, the distance between the head section and the recording sheet 212, i.e., the distance between the recording sheet 212 and the thin plate 202, is required to be short.

As the elements for controlling the recording characteristic there are the configuration of the convex portion 214, the configuration of the ink discharge opening 204, the configuration of the concave portion 203, the dielectric constant of the thin plate 202, the material value of the ink and others. Particularly, the effective range of the dielectric constant of the thin plate 202 is about 1 to 8, and as the value is smaller, the responsibility can more be heightened and the drive voltage can be lowered, thereby improving the recording characteristic. As the material therefor there is effective a glass, ceramic, resin or the like. In terms of the material characteristic of the ink, the value of the resistivity is particularly important and required to be set to be in a range of $10^4$ to $10^8$ Ωcm.

Figure 3:
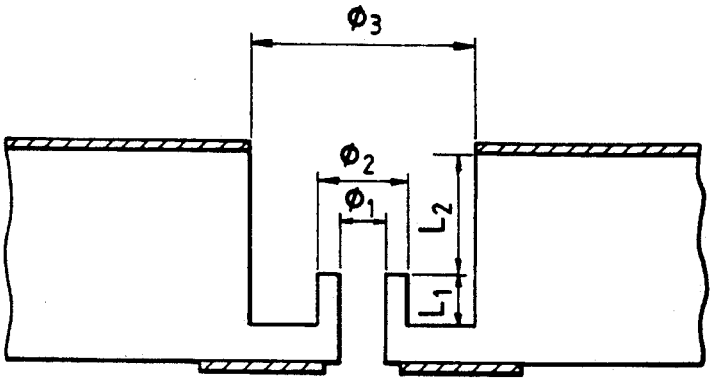
FIG. 3 is a cross-sectional view for describing a dimension of portions of the FIG. 2 ink-jet recording apparatus.

FIG. 3 is a cross-sectional view for showing one example of the detailed dimension of the ink-jet recording apparatus of this embodiment. In FIG. 3, $\phi 1$ represents the diameter of the ink discharge opening 204, $\phi 2$ designates the diameter of the convex portion 214, $\phi 3$ denotes the diameter of the concave portion 203, $L_1$ depicts the height of the convex portion 214, and $L_2$ indicates the length from the top surface of the convex portion 214 (the ink discharge opening 204) to the front surface of the thin plate 202, i.e., the electrode 206. The respective values are as follows:

$\phi 1$: 0.03 to 0.20 mm;

$\phi 2$: $\phi 1+0.02$ mm or more;

$\phi 3$: 2 to 10 times of $\phi 1$;

$L_1$: 1/5 time of $\phi 1$ or more; and $L_2$: 1 to 20 times of $\phi 1$.

Figure 4:
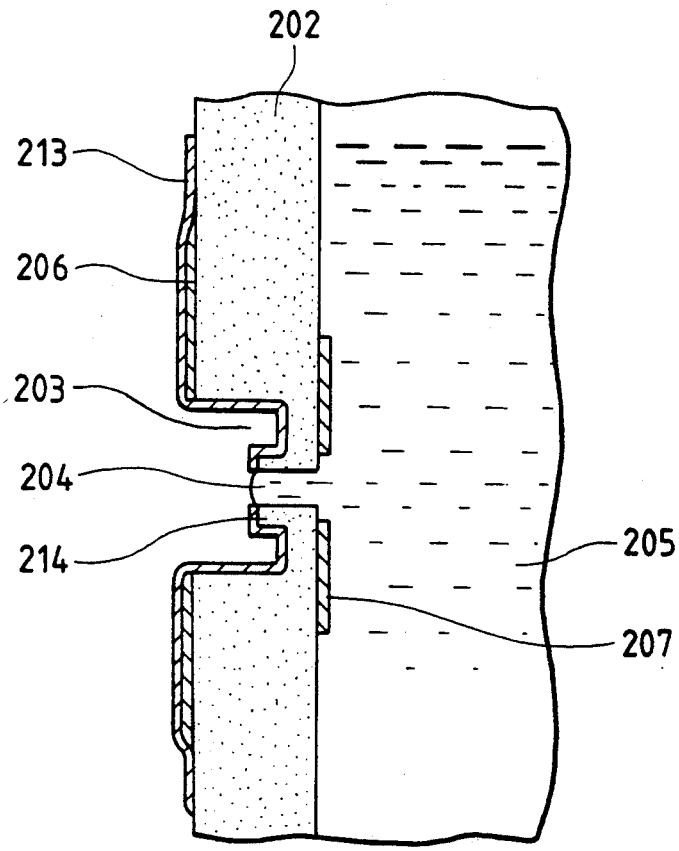
FIG. 4 is an enlarged view showing a nozzle section of the FIG. 2 ink-jet recording apparatus.

Since the the recording characteristic is deteriorated when unnecessary ink is attached to the inside or the vicinity of the concave portion 203, as illustrated in FIG. 4 (enlarged view of the concave portion), an ink-eliminating material 213 for flipping or eliminating ink is coated on the concave portion 203 and at the vicinity thereof. Here, if the thin plate 202 is made of a material such as Teflon essentially having the ink-eliminating characteristic, the coating to be made with respect to the inside of the concave portion 203 is not required.

According to the present invention, although the responsibility and the drive voltage are slightly deteriorated as compared with the prior art apparatus shown in FIG. 1, the structure is simplified so as to provide great advantages in cost and assembling.

Figure 5:
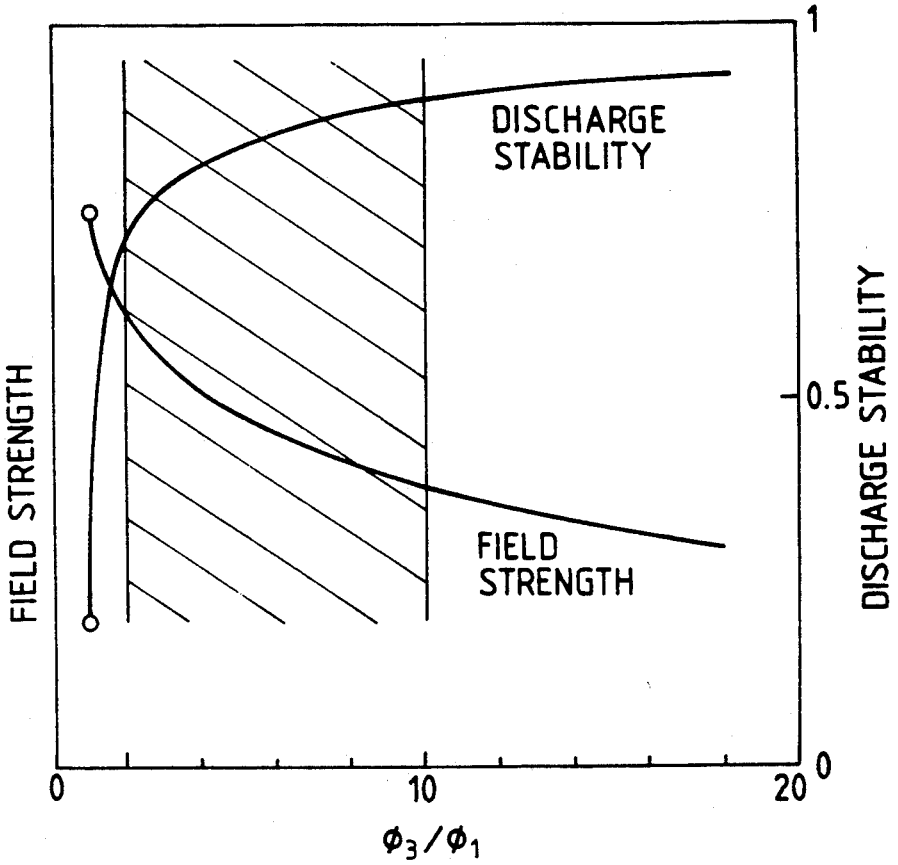
FIG. 5 is a graphic diagram showing the relation between the diameters $\phi 1$ and $\phi 3$ of an ink discharge opening and a concave portion and the recording characteristic in FIG. 2 ink-jet recording apparatus.

Secondly, a description will be made hereinbelow with reference to FIG. 5 in terms of the characteristic of the head section of an ink-jet recording apparatus according this invention. FIG. 5 is a graphic illustration for describing the relation between the diameters $\phi 1$ and $\phi 3$ of the ink discharge opening 204 and concave portion 203 and the recording characteristic. In FIG. 5, the horizontal axis represents the ratio $\phi 3/\phi 1$ (here, $\phi 1$ is fixed to 0.06 mm) and the vertical axis depicts the electric field strength and the discharge stability. The electric field strength corresponds to the energy for drawing the ink and is based upon the signal voltage from the signal source 211. The discharge stability indicates the probability that the swinging angle of the ink discharged becomes below 0.5 degree and the stabler recording can be effected as the probability is closer to 1. As clear from FIG. 5, the electric field strength is lowered in accordance with increase in the ratio $\phi 3/\phi 1$ so as to take the inverse number of a quadratic function. On the other hand, the discharge stability is remarkably improved within the region equal to or greater than the point of $\phi 3/\phi 1=2$. From the illustration, if taking into account the arrangement density of the nozzles, the range of $\phi 3/\phi 1$ is effective to be $2 \leqq \phi 3/\phi 1 \leqq 10$.

Figure 6:
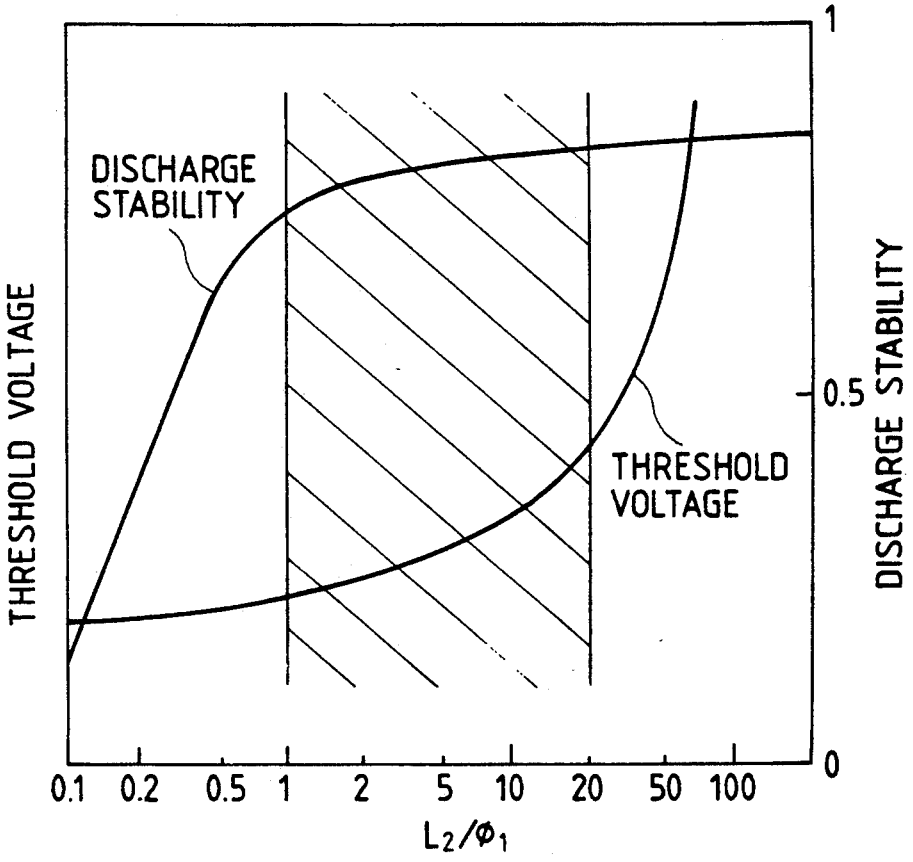
FIG. 6 is a graphic diagram showing the relation between the diameter $\phi 1$ of the ink discharge opening, the distance $L_2$ from the top surface of the ink discharging opening to the first electrode and the recording characteristic.

FIG. 6 shows the relation between the diameter $\phi 1$ of the ink discharge opening 204, the distance $L_2$ from the top surface of the convex portion 214 to the first electrode 206 and the recording characteristic. In FIG. 6, the horizontal axis represents the ratio $L_2/\phi 1$ (here, $\phi 1$ is fixed to 0.06 mm) in logarithm scale and the vertical axis denotes the minimum voltage for allowing the discharge of ink, i.e., a threshold voltage, and the discharge stability (described above). The threshold voltage rapidly increases from the vicinity of $L_2/\phi 1=20$, and the discharge stability is remarkably improved within the region equal to or greater than the point of $L_2/\phi 1=1$. Thus, the effective range of $L_2/\phi 1$ is considered as $1 \leqq L_2/\phi 1 \leqq 20$.

Figure 7:
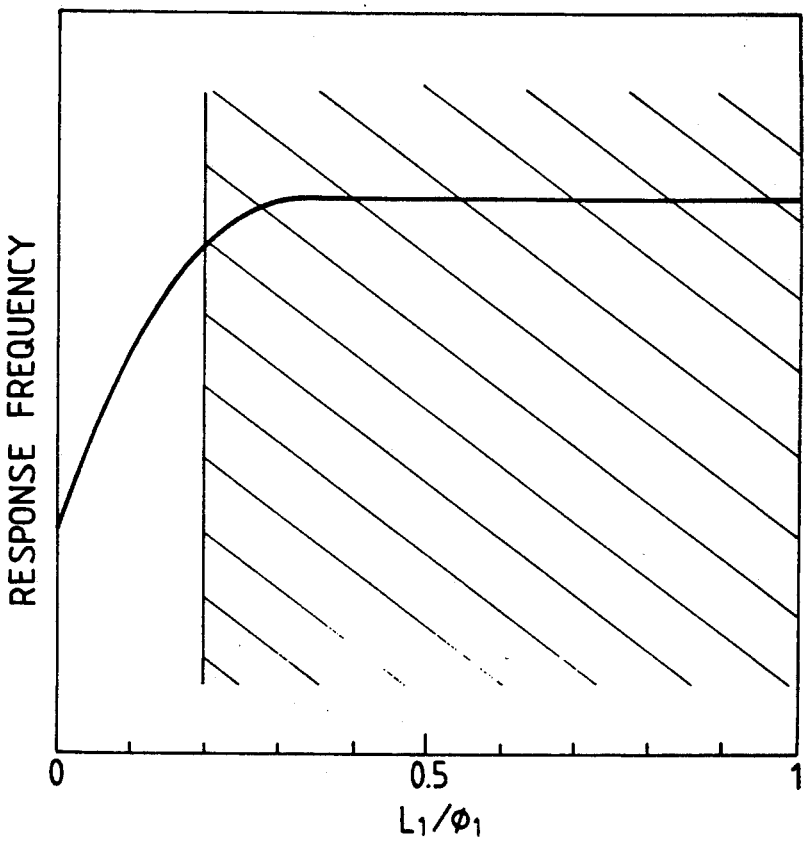
FIG. 7 is a graphic diagram showing the relation between the height $L_1$ of the convex portion, the diameter $\phi 1$ of the ink discharge opening and the recording characteristic.

Further, FIG. 7 illustrates the relation between the height $L_1$ of the convex portion 214, the diameter $\phi 1$ of the ink discharge opening 204 and the recording characteristic. In FIG. 7, the horizontal axis represents the ratio $L_1/\phi 1$ ($\phi 1$ is fixed to 0.06 mm) and the vertical axis indicates the response frequency. The response frequency substantially becomes constant from the vicinity of $L_1/\phi 1=0.2$. This means that the degree of the electric field concentration continuously increases up to the value. Thus, in terms of the response frequency, $L_1/\phi 1 \geqq 0.2$ is preferable.

According to the above-described conditions, it is possible to set the optimal recording characteristic concurrently with simplifying the structure to reduce the cost.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention. For example, although in the above-described embodiment the ink supply passage 208 is connected to the ink tank 209, it is appropriate that the ink tank is directly provided at the rear side of the ink chamber 205.

What is claimed is:

1. An ink-jet recording apparatus comprising:

a concave portion formed in a thin plate made of an insulating material;

a discharge opening formed at a center and bottom portion of said concave portion;

a circular convexed portion surrounding said discharge opening;

a first electrode provided on one surface of said thin plate and around said concave portion;

a second electrode provided on another surface of said thin plate and in the vicinity of said discharge opening;

a signal source coupled to said first electrode and said second electrode;

an ink chamber communicating with said discharge opening; and an ink tank coupled through an ink supply passage to said ink chamber.

2. An ink-jet recording apparatus comprising:

a concave portion formed in a thin plate made of an insulating material, said concave portion having an opening diameter of $\phi 3$;

a convex ink-discharging portion formed at a center and bottom portion of said concave portion, said convex ink-discharging portion having an opening of a diameter of $\phi 1$;

a first electrode disposed at a peripheral portion of said concave portion;

a second electrode disposed in the vicinity of said ink-discharge opening;

a signal source coupled to said first electrode and said second electrode; and an ink chamber coupled to said ink-discharge opening, wherein, when a height of said convex ink-discharging portion is taken to be $L_1$ and a distance from a top surface of said convex ink-discharging portion to said first electrode is taken as $L_2$, a following relation is satisfied:

$$2 \leqq \phi 3/\phi 1 \leqq 10,\ 1 \leqq L_2/\phi 1 \leqq 20, \text{ and } L_1/\phi 1 \geqq 0.2.$$

* * * * *